US009390870B2

(12) United States Patent
Gouhl et al.

(10) Patent No.: US 9,390,870 B2
(45) Date of Patent: Jul. 12, 2016

(54) WIRING DEVICE WITH TOGGLE SPRING CUP

(71) Applicants: Erik Jeffrey Gouhl, Fayetteville, GA (US); Dai Vo, Mcdonough, GA (US)

(72) Inventors: Erik Jeffrey Gouhl, Fayetteville, GA (US); Dai Vo, Mcdonough, GA (US)

(73) Assignee: Cooper Technologies Company, Houston, TX (US)

( * ) Notice: Subject to any disclaimer, the term of this patent is extended or adjusted under 35 U.S.C. 154(b) by 283 days.

(21) Appl. No.: 14/137,574

(22) Filed: Dec. 20, 2013

(65) Prior Publication Data

US 2015/0179372 A1 Jun. 25, 2015

(51) Int. Cl.
*H01H 21/42* (2006.01)
*H01H 3/04* (2006.01)
*H01H 21/12* (2006.01)

(52) U.S. Cl.
CPC ..... *H01H 21/42* (2013.01); *H01H 21/12* (2013.01)

(58) Field of Classification Search
CPC ..... H01H 21/12; H01H 21/24; H01H 21/42
USPC ..... 200/400, 401, 335; 335/171, 172
See application file for complete search history.

(56) References Cited

U.S. PATENT DOCUMENTS 1,793,412 A * 2/1931 McKinley ..... H01H 1/16 200/285
8,420,968 B2 * 4/2013 Park ..... H01H 71/501 200/401

* cited by examiner

*Primary Examiner* — Amy Cohen Johnson
*Assistant Examiner* — Marina Fishman
(74) *Attorney, Agent, or Firm* — King & Spalding LLP

(57) ABSTRACT

The present disclosure provides techniques or an electrical wiring device with symmetric and robust actuation. An electrical wiring device includes a toggle assembly comprising a compression spring and a spring cup disposed at one end of the compression spring. The spring cup includes a lower portion and an upper portion. The lower portion includes an outer diameter at most as large at the inner diameter of the compression spring and is disposed within the end of the compression spring. The upper portion has a recess therein and is configured to receive a spring seat of a toggle, and allows the spring seat to rotate within the recess when the toggle is actuated.

19 Claims, 5 Drawing Sheets

WIRING DEVICE WITH TOGGLE SPRING CUP

TECHNICAL FIELD

The present invention relates generally to electrical wiring devices and more particularly, to electrical wiring devices with a toggle spring cup for crisp actuation.

BACKGROUND

Wiring devices, such as toggle style switches, are often used to turn a load on and off. Specifically, actuation, or switching, of a toggle switch moves a movable contact inside the wiring device into or out of contact with one or more stationary contacts. Traditionally, in certain toggle style switching devices, a toggle is biased in one of two positions by a compression spring. The toggle includes one or more cams, which actuate the movable contacts that open and close the switch. For example, in an off position, the toggle is biased towards a position where the cams open the contacts. In an on position, the toggle is biased in the opposing position, in which the cams close the contacts. The compression switch is captured between the toggle and a bottom housing of the wiring device and is designed to facilitate the switching of the toggle. Typically the toggle includes a post which reaches inward into the housing and a spring seat at the end of the post, which is disposed partially within the compression spring. However, since there is a clearance between the spring seat and the inner diameter of the compression spring, the compression spring can bias randomly to one side or the other, rather than concentrically encompassing the spring seat. When the toggle is actuated, this can have the effect of either having a very crisp snap in one direction and a lazy or sloppy switching action in the other direction rather than having a desirable consistent and balanced feeling in both directions.

SUMMARY

An example embodiment of the present invention includes a wiring device. The wiring device includes a housing including a plurality of walls forming a cavity therein, the plurality of walls including a housing top. The wiring device further includes a toggle assembly disposed at least partially within the cavity. The toggle assembly includes a compression spring comprising a first end, a second end, and an inner diameter. The toggle assembly also includes a spring cup comprising a lower portion and an upper portion, the lower portion coupled to the first end of the compression spring, and the upper portion forming a recess therein. The toggle assembly further includes a toggle comprising a toggle post and a spring seat disposed at a distal end of the toggle post, the spring seat disposed at least partially within the recess, the toggle positionable into at least a first position and a second position. The wiring device further includes a first contact and a second contact disposed within the housing. The first and second contacts are closed when the toggle is in the first position and open when the toggle is in the second position.

Another example embodiment of the present invention includes a wiring device. The wiring device includes a toggle assembly. The toggle assembly includes a compression spring comprising a first end, a second end, and an inner diameter. The toggle assembly includes a spring cup having a lower portion and an upper portion, the lower portion having an outer diameter at most as large at the inner diameter of the compression spring and disposed within the first end of the compression spring, the upper portion forming a recess therein. The toggle assembly further includes a toggle having a toggle post and a spring seat disposed at a distal end of the toggle post. The spring seat is disposed at least partially within the recess, and the toggle is positionable into an first position and a second position.

Another example embodiment of the present invention includes a wiring device. The wiring device includes a spring cup. The spring cup includes a lower portion comprising a first cylindrical shape and a first outer diameter. The spring cup further includes an upper portion comprising a second cylindrical shape and a second outer diameter, the upper portion forming a recess therein. The lower portion is adjacent and concentric with the upper portion, and the second outer diameter is larger than the first outer diameter.

BRIEF DESCRIPTION OF THE DRAWINGS

The foregoing and other features and aspects of the invention are best understood with reference to the following description of certain example embodiments, when read in conjunction with the accompanying drawings, wherein.

BRIEF DESCRIPTION OF EXAMPLE EMBODIMENTS

Figure 1:
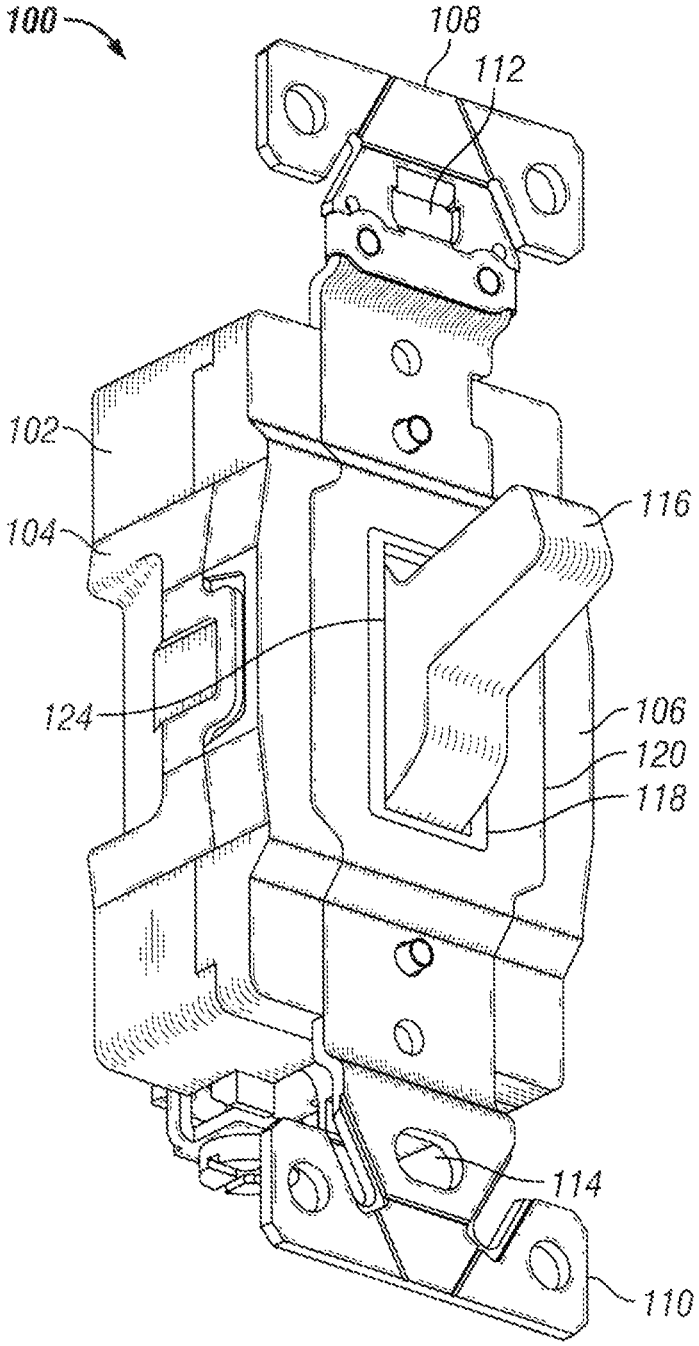
FIG. 1 illustrates a perspective view of a wiring device with a spring cup in accordance with an example embodiment of the present invention.

The embodiments of the present invention are directed to wiring devices having toggle switches. Although the description of example embodiments is provided below in conjunction with a two-way toggle style wiring device, alternate embodiments of the invention are applicable to other types of electrical wiring devices including, but not limited to, paddle switches, three-way toggle switches, other styles of switches, and any other electrical wiring device known to people having ordinary skill in the art. The invention is better understood by reading the following description of non-limiting, example embodiments with reference to the attached drawings, wherein like parts of each of the figures are identified by like reference characters, and which are briefly described as follows.

The present disclosure presents a toggle style wiring device with an actuator spring cup, which provides symmetric biasing and crisp and robust actuation as a toggle is switched from side to side. FIG. 1 is a perspective view of a wiring device 100 with a spring cup 208 (FIG. 2) in accordance with an example embodiment of the present invention. Referring to FIG. 1, the wiring device 100 is substantially rectangularly shaped and includes, as is seen externally, a housing 102, a first mounting yoke 108, a second mounting yoke 110, and a toggle 116. The housing 102 is a substantially rectangularly shaped shell that includes an inner cavity 201 (FIG. 2) therein, but is capable of being formed in other geometric or non-geometric shapes if desired. The housing 102 is dimensioned to fit within a wall box (not shown) according to some example embodiments. In the illustrated example embodiment, the housing 102 includes a housing base 104 and a housing top 106, which are fabricated separately and joined together to form the housing 102. The housing base 104 and the housing top 106 have similar profiles such that when joined, the profiles are substantially aligned. In certain example embodiments, the inner cavity 201 (FIG. 2) is located within the housing base 104, in which electronic components and contacts are disposed. The housing top 106 generally remains visible to an end-user once the wiring device 100 is installed within the wall box, before a wall plate (not shown) is installed according to certain example embodiments. When the wall plate is installed, the housing 102, including at least a portion of the housing top 106 is generally not visible to the end-user according to certain example embodiments. In certain example embodiments, the housing top 106 includes a substantially rectangular opening 124 located centrally within the housing top 106. At least a portion of the toggle 116 is disposed within and/or through the opening 124. In certain example embodiments, a skirt 118 is disposed within the opening 124 and around the toggle 116, essentially between the housing top 106 and the toggle 116. In certain example embodiments, the housing 102 is fabricated from a material such as polycarbonate.

In certain example embodiments, the toggle 116 is positionable into at least two positions, which are an on position 450 (FIG. 4) and an off position 350 (FIG. 3), in which the toggle 116 is switched to one side in the on position 450 and the opposing side in the off position 350. In certain example embodiments, the toggle 116 is positionable into a third, neutral position 250 (FIG. 2), in which the toggle 116 is between the on position 450 and off position 350.

The first mounting yoke 108 and the second mounting yoke 110 are both partially disposed on or in the housing 102. Generally, the first mounting yoke 108 and the second mounting yoke 110 extend lengthwise of the housing 102 in opposite directions, respectively. In certain example embodiments, the first mounting yoke 108 and the second mounting yoke 110 are formed as a single component with a middle portion 120 which traverses a length of the housing top 106. However, in some example embodiments, the first mounting yoke 108 and the second mounting yoke 110 are formed separately from one another and are optionally coupled to each other or to the housing 102. The first mounting yoke 108 includes one or more first coupling apertures 112 formed within the first mounting yoke 108, and the second mounting yoke 110 includes one or more second coupling apertures 114 formed within the second mounting yoke 110. These apertures 112 and 114 are used to couple the wiring device 100 to a wall box using a screw (not shown) or other fastening device known to those having ordinary skill in the art. The first mounting yoke 108 and the second mounting yoke 110 are fabricated using a metal, such as steel, but are fabricated using other suitable materials known to people having ordinary skill in the art in other example embodiments.

In certain example embodiments, the wiring device 100 is an all-load switch. As such, the wiring device 100 is compatible for use with a variety of load types, such as incandescent lights, LEDs, florescent lights, and so forth. In certain example embodiments, the wiring device 100 includes a dimmer. In certain example embodiments, the wiring device 100 includes a dimmer with preset, which has the ability to open and close the associated circuit with the load set to a predetermined output level. However, in certain other example embodiments, the wiring device 100 is configured to function in other ways not detailed herein for sake of brevity, such as, for example, providing power to a receptacle device.

Figure 2:
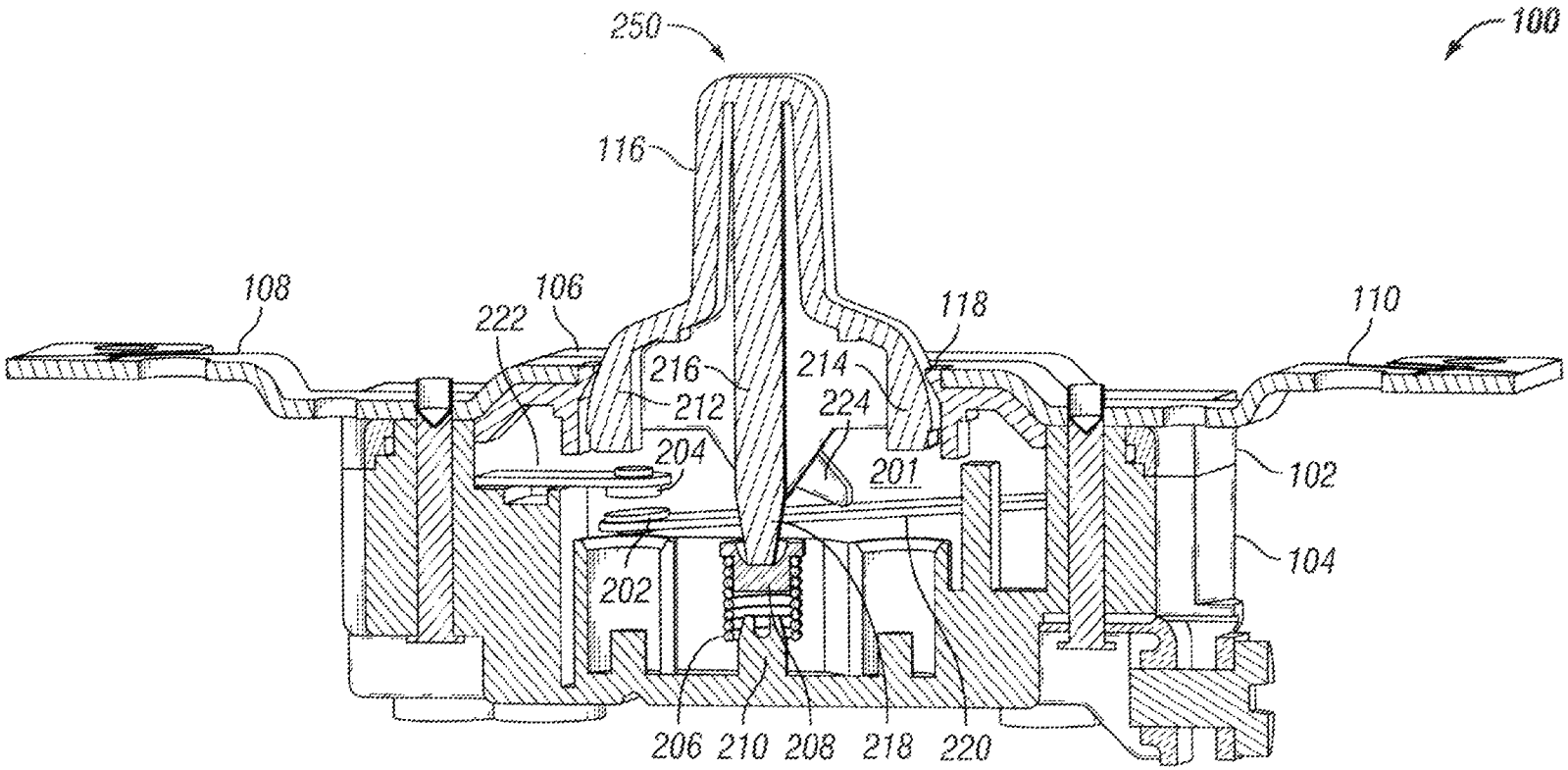
FIG. 2 illustrates a cross-sectional side view of the wiring device of FIG. 1 with a toggle in a neutral or middle position, in accordance with an example embodiment of the present invention.
Figure 3:
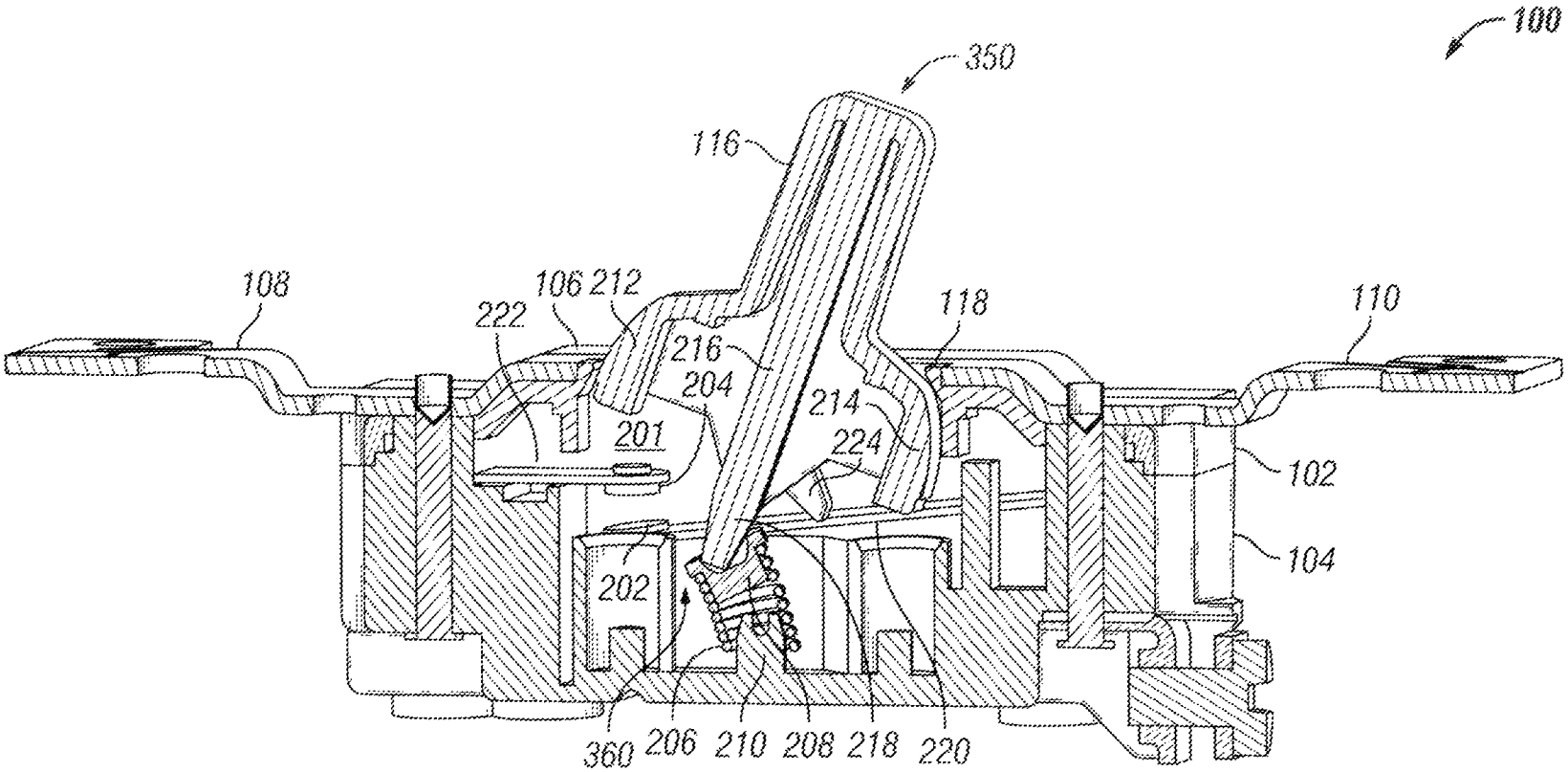
FIG. 3 illustrates a cross-sectional side view of the wiring device of FIG. 1 with the toggle in an off position, in accordance with an example embodiment of the present invention.
Figure 4:
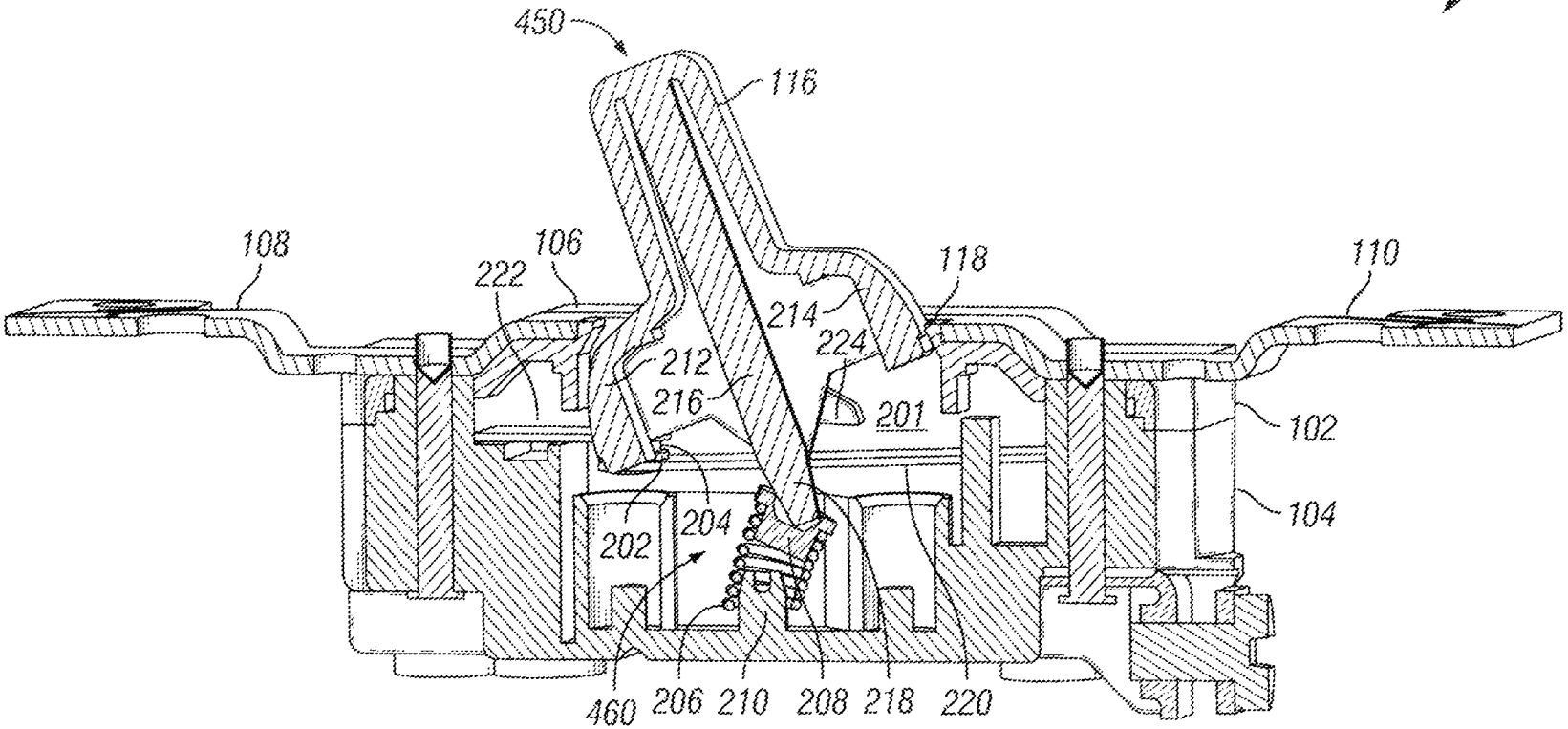
FIG. 4 illustrates a cross-sectional view of the wiring device of FIG. 1 with the toggle in an on position, in accordance with an example embodiment of the present invention.
Figure 5:
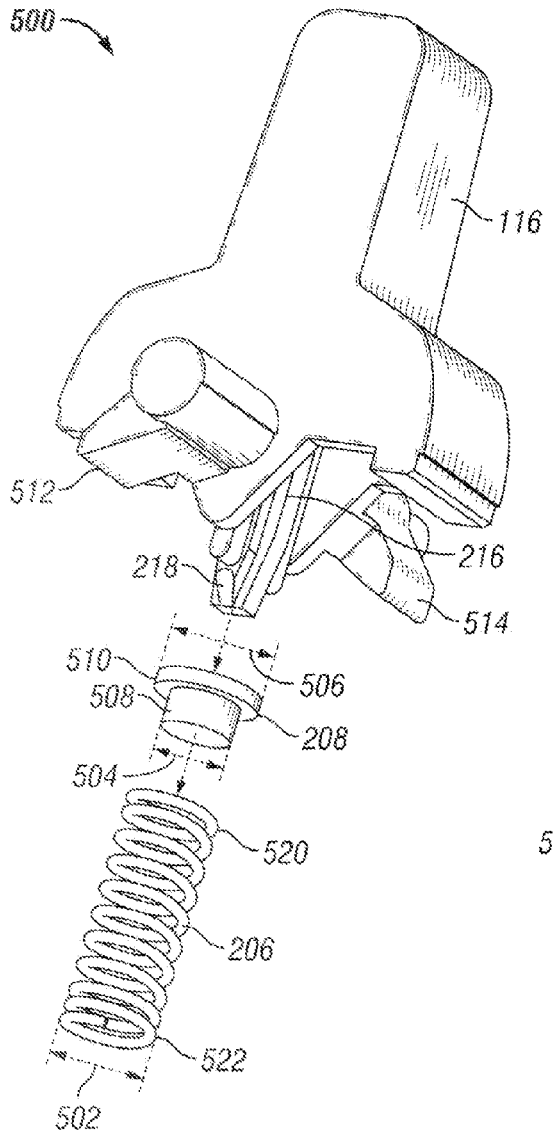
FIG. 5 illustrates an exploded view of a toggle assembly, in accordance with an example embodiment of the present invention.

FIG. 2 illustrates a cross-sectional side view of the wiring device 100 with the toggle 116 in a neutral or middle position 250, in accordance with an example embodiment of the present invention. FIG. 3 illustrates a cross-sectional side view of the wiring device 100 with the toggle 116 in an off position 350, in accordance with example embodiments. FIG. 4 illustrates a cross-sectional view of the wiring device 100 with the toggle 116 in an on position 450, in accordance with example embodiments. Referring to FIGS. 2, 3, and 4, in addition to the housing 102, mounting yokes 108, 110, and toggle 116, the wiring device 100 further includes a stationary contact 204, a movable contact 202, a compression spring 206, a spring pivot 210, and a spring cup 208 disposed within the cavity 201 of the wiring device 100. The movable contact 202 is disposed next to the stationary contact 204 with a distance of separation between the movable contact 202 and the stationary contact 204 when the toggle 116 is in the neutral position 250 or the off position 350. In certain example embodiments, the stationary contact 204 is disposed horizontally, or substantially parallel to the housing top 106. In such an example embodiment, the movable contact 202 is disposed substantially parallel to and below the stationary contact 204. In certain example embodiments, the stationary contact 204 includes a stationary arm 222 which electrically couples the stationary contact 204 to a first terminal (not shown). Likewise, the movable contact 202 includes a movable arm 220, which electrically couples the movable contact 202 to a second terminal (not shown). In certain example embodiments, the toggle 116 further includes a first tab 212, a second tab 214, and a toggle post 218. The first tab 212 and the second tab 214 are disposed on either side of the toggle 116 and extend into the cavity 201 of the wiring device 100. In an example embodiment, when the toggle 116 is in the neutral position 250, the first tab 212 and the second tab 214 each extend a distance into the cavity 201 of the wiring device 100. In certain example embodiments, the toggle 116 further includes a cam 224 coupled to and extending outwardly from the toggle post 216. When the toggle is in the off position 350, the cam 224 is tilted towards the movable arm 220, pushing it downward. This downward force keeps the movable contact 202 separated from the stationary contact 204. The movable arm 220 has a neutral position in which the movable contact 202 is in contact with the stationary contact 204. Thus, when the toggle is in the on position 450, the cam 224 is tilted away from the movable arm 220 and the movable 220 is allowed to be in its neutral position, in which the movable contact 202 is in contact with the stationary contact 204. The toggle post 216 is coupled to the middle of the toggle 116 from the inside and extends into the cavity 201 of the wiring device 100. In certain example embodiments, the toggle post 216 includes a spring seat 218 disposed at a distal end of the toggle post 216. In certain example embodiments, the spring seat 218 has at least a partially spherical profile. In certain other example embodiments, the spring seat 218 has another profile geometry, such as tapered, cylindrical, square, conical, and the like. In certain example embodiments, the spring seat 218 is coupled to the spring cup 208, which is coupled to the compression spring 206, which is coupled to and retained by the spring pivot 210. In certain example embodiments, the toggle 116, the spring cup 208, and the compression spring 206 make up a toggle assembly 500, as illustrated in FIG. 5. Specifically, FIG. 5 illustrates an exploded view of the toggle assembly 500, in accordance with example embodiments. Referring to FIG. 5, the compression spring 206 is a coil with a degree of separation in a neutral state, as shown in FIG. 5. The compression spring 206 has a proximal end 520, a distal end 522, and an inner diameter 502. Referring to FIGS. 2 and 5, the proximal end 520 is configured to couple to the spring pivot 210. In certain example embodiments, the spring pivot 210 is fitted within the inner diameter 502 of the compression spring 206, thereby retaining the compression spring 206 thereon.

Figure 6:
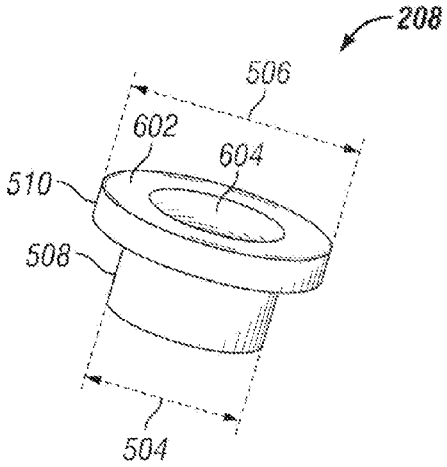
FIG. 6 illustrates a top perspective view of the spring cup of FIG. 5, in accordance with example embodiments of the present invention.

FIG. 6 illustrates a top perspective view of the spring cup 208, in accordance with example embodiments of the present disclosure. Referring to FIGS. 5 and 6, in certain example embodiments, the spring cup 208 includes a lower portion 508 and an upper portion 510. In certain example embodiments, the lower portion 508 has a cylindrical shape and is configured to fit concentrically within the inner diameter 502 of the compression spring 206. The lower portion 508 generally fits snuggly within the inner diameter 502. Thus, the lower portion 508 includes an outer diameter equal to or just smaller than the inner diameter 502 of the compression spring 206. As such, the clearance between the lower portion 508 and the compression spring 206 is minimized and the spring cup 208 is disposed stably within the compression spring 206 and moves as substantially one body with the compression spring 206. In certain example embodiments, the upper portion 510 also includes a cylindrical shape and is concentric to the lower portion 508. The upper portion 510 includes an outer diameter 506 larger than the inner diameter 502 of the compression spring 206. Thus, the lower portion 508 of the spring cup 208 is disposed through the compression spring 206 until the compression spring 206 reaches and abuts the upper portion 510, as shown in FIG. 2. Referring to FIG. 6, the spring cup 208 includes an upper surface 602 formed on the upper portion 510. The spring cup 208 further includes a recess 604 formed within the upper surface 602 and the upper portion 510. In certain example embodiments, the recess 604 has a curved profile or a partial spherical profile. In certain example embodiments, the recess 604 has a different geometric profile. In certain example embodiments, the recess 604 includes a geometric profile complimentary to the geometry of the spring seat 218. In certain example embodiments, the recess 604 and the spring seat 218 are shaped to facilitate a certain degree of contacting rotation of the spring seat 216 within the recess 604.

Referring to FIGS. 2, 5, and 6, the recess 604 is configured to receive the spring seat 218 of the toggle post 216. Specifically, the compression spring 206 which is coupled and compressed between the spring pivot 210 and the spring cup 208 urges the spring cup 208 upward against the spring seat 218. Referring to FIG. 2, in certain example embodiments, the compression spring 206 is fully compressed in the neutral position 250, in which the toggle post 216 is aligned with the compression spring 206 and in midline with the wiring device 100. In this disclosure a state of being fully compressed refers to the greatest degree of compression the compression spring 206 is put into during use of the wiring device 100, and does not necessarily refer to a state of maximum compression of the spring 206. Referring to FIG. 3, in certain example embodiments, as the toggle 116 is switched to the off position 350, the toggle post 216 and spring seat 218 are biased to a first side 360. As the spring seat 218 swings towards the first side 360, the spring seat 218 rotates with respect to the recess 604 of the spring cup 208 and drives the spring cup 208 towards the first side 360. As the spring cup 208 passes the mid line, the compressed compression spring 208 decompresses upwards, pushing the spring cup 208 and the spring seat 218 further up and towards the first side 360, due to the potential energy store in the compressed compression spring 206 and the length of the toggle post 216. Thus, the toggle 116 is further driven and biased into the off position 350. The decompression of the spring 208 and the upward spring force applied by the compression spring 208 facilitates the switching motion of the toggle 116 and creates a clean and robust snap from the neutral position 250 into the off position 350. The movable contact 202 is decoupled from the stationary contact 204 when the toggle 116 is in the off position 350.

Referring to FIG. 4, as the toggle 116 is switched to the on position 450, the toggle post 216 and spring seat 218 are biased to a second side 460. As the spring seat 218 swings towards the second side 460, the spring seat 218 rotates with respect to the recess 604 of the spring cup 208 and drives the spring cup 208 towards the second side 460. As the spring cup 208 passes the mid line, the compressed compression spring 208 decompresses upwards, pushing the spring cup 208 and the spring seat 218 further up and towards the second side 460, due to the potential energy stored in the compressed compression spring 206 and the length of the toggle post 216. Thus, the toggle is further driven and biased into the on position 450. The decompression of the spring and the upward spring force applied by the compression spring facilitates the switching motion of the toggle 116 and creates a clean and robust snap from the neutral position 250 into the on position 450.

In certain example embodiments, when the toggle 116 is actuated from the off position 350 directly into the on position 450, the toggle post 216 and the spring seat 218 are pushed down and towards the midline. As such, the compression spring 206 is further compressed via the spring cup 208 and moved towards being aligned with the midline as well. As the switching motion takes the toggle 116 into alignment with the midline, the toggle post 216, spring seat 218, spring cup 208, and compression spring 206 are all aligned with the midline and the compression spring 206 is fully compressed. As the switching motion of the toggle 116 takes the toggle post 216 past the midline, the compression spring 206 decompresses upwards as described above and biases the toggle into the on position 450. In certain example embodiments, the motion and movement of parts is reversed and symmetric as the toggle 116 is actuated from the on position into the off position 350.

In certain example embodiments, the toggle post 216 is maintained in the center of the recess 604 of the spring cup 206 in the neutral position 250 and moves symmetrically with respect to the spring cup 206 going into the off position 350 and the on position 450, and the spring cup 206 and the recess 604 is concentrically and symmetrically fitted within the inner diameter 502 of the compression spring 206. Thus, the toggle post 216 is maintained in the middle of the compression spring 206 in the neutral position 250 and affects symmetrical movement of the compression spring 206 as the toggle 116 goes into the on position 450 and the off position 350. The compression spring 206 pushes the spring seat 218 and toggle post 216 with substantially same motion and force in the on position 450 and the off position 350. Thus, the toggle 116 experiences a crisp and robust actuation into both the on position 450 and the off position 350, providing a symmetric and consistent actuation feedback to a user.

In certain example embodiments, the spring cup 206 includes a lower portion having a recess configured to retain the proximal end 520 of the compression spring 206 such that the proximal end 520 is snugly fit within the lower portion of the spring cup 206.

Although each example embodiment has been described in detail, it is to be construed that any features and modifications that are applicable to one example embodiment are also applicable to the other example embodiments. Furthermore, although the invention has been described with reference to specific example embodiments, these descriptions are not meant to be construed in a limiting sense. Various modifications of the disclosed example embodiments, as well as alternative example embodiments of the invention will become apparent to persons of ordinary skill in the art upon reference to the description of the example embodiments. It should be appreciated by those of ordinary skill in the art that the conception and the specific example embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A wiring device, comprising:

a housing comprising a plurality of walls forming a cavity therein, the plurality of walls comprising a housing top and a housing base that are coupled to each other to form the cavity, wherein the housing base includes a spring pivot that is integral with the housing base and is stationary;

a toggle assembly disposed at least partially within the cavity, the toggle assembly comprising:

a compression spring comprising a first end, a second end, and an inner diameter;

a spring cup comprising a lower portion and an upper portion, the lower portion coupled to the first end of the compression spring, and the upper portion forming a recess therein, wherein the second end of the compression spring receives and fits around the spring pivot such that the compression spring pivots on the spring pivot that is stationary; and a toggle comprising a toggle post and a spring seat disposed at a distal end of the toggle post, the spring seat disposed at least partially within the recess, the toggle positionable into at least a first position and a second position;

a first contact and a second contact disposed within the housing, wherein the first and second contacts are closed when the toggle is in the first position and open when the toggle is in the second position.

2. The wiring device of claim 1, wherein the lower portion of the spring cup has an outer diameter at most as large as the inner diameter of the compression spring and disposed within the first end of the compression spring.

3. The wiring device of claim 1, wherein the spring seat is at least partially spherical and the recess comprises at least a partially spherical profile.

4. The wiring device of claim 1, wherein the toggle further comprises at least one cam configured to drive the first contact into contact with the second contact when the toggle is put into the first position, wherein the at least one cam extends outwardly from the toggle post.

5. The wiring device of claim 1, wherein the upper portion of the spring cup comprises an outer diameter larger than the inner diameter of the compression spring.

6. The wiring device of claim 1, wherein the toggle assembly experiences symmetric motion as the toggle is switched into the on position and the off position.

7. The wiring device of claim 1, wherein the toggle is positionable in a neutral position between the on position and the off position, wherein in the neutral position, the toggle, toggle post, the spring seat, and the compression spring are aligned.

8. The wiring device of claim 6, wherein the toggle post and the spring seat are aligned with the center point of the compression spring when the toggle is in the neutral position.

9. The wiring device of claim 1, wherein the compression spring urges the spring seat upward and towards a first side when the toggle is put into the on position.

10. The wiring device of claim 9, wherein the compression spring urges the spring seat upward and towards a second side opposite the first side when the toggle is put into the off position.

11. The wiring device of claim 10, wherein the spring seat rotates within the recess of the spring cup as the toggle is put into the on position and when the toggle is put into the off position.

12. A wiring device, comprising:

a toggle assembly, the toggle assembly comprising:

a compression spring comprising a first end, a second end, and an inner diameter;

a spring cup comprising a lower portion and an upper portion, the lower portion having an outer diameter at most as large as the inner diameter of the compression spring and disposed within the first end of the compression spring, the upper portion forming a recess therein; and a toggle comprising a toggle post and a spring seat disposed at a distal end of the toggle post, the spring seat disposed at least partially within the recess, the toggle positionable into a first position and a second position, wherein the second end of the compression spring receives and fits around a spring pivot such that the compression spring pivots on the spring pivot, and wherein the spring pivot is integral with a housing of the wiring device and is stationary.

13. The wiring device of claim 12, wherein the spring seat is at least partially spherical and the recess comprises at least a partially spherical profile.

14. The wiring device of claim 12, wherein the upper portion of the spring cup comprises an outer diameter larger than the inner diameter of the compression spring.

15. The wiring device of claim 12, wherein the toggle is positionable in a neutral position between the on position and the off position, wherein in the neutral position, the toggle, toggle post, the spring seat, and the compression spring are aligned.

16. The wiring device of claim 15, wherein the toggle post and the spring seat are aligned with the center point of the compression spring when the toggle is in the neutral position.

17. A wiring device, comprising:

a spring cup, the spring cup comprising:

a lower portion comprising a first cylindrical shape and a first outer diameter; and an upper portion comprising a second cylindrical shape and a second outer diameter, the upper portion forming a recess therein, wherein the lower portion is adjacent and concentric with the upper portion; and wherein the second outer diameter is larger than the first outer diameter;

a compression spring, the compression spring comprising a first end, a second end, and an inner diameter, wherein the lower portion of the spring cup is disposed within the inner diameter and the first end of the compression spring, and wherein the second end of the compression spring receives and fits around a stationary spring pivot such that the compression spring pivots on the stationary spring pivot that is integral with a housing of the wiring device.

18. The wiring device of claim 17, wherein the recess comprises a curved, rounded, or at least partially spherical profile.

19. The wiring device of claim 17, wherein the lower portion of the spring cup fits snugly within the inner diameter of the compression spring, and wherein the recess is concentrically aligned with the compression spring.

* * * * *